US006125800A

United States Patent [19]

Lugs

[11] Patent Number: 6,125,800

[45] Date of Patent: Oct. 3, 2000

[54] COOLING SYSTEM FOR A LIQUID-COOLED INTERNAL COMBUSTION ENGINE

[75] Inventor: Werner Lugs, Neuzeug, Austria

[73] Assignee: Bayerische Motoren Werke Aktiengesellschaft, Munich, Germany

[21] Appl. No.: 09/142,996

[22] PCT Filed: Mar. 15, 1997

[86] PCT No.: PCT/EP97/01318

§ 371 Date: Nov. 18, 1998

§ 102(e) Date: Nov. 18, 1998

[87] PCT Pub. No.: WO97/35101

PCT Pub. Date: Sep. 25, 1997

[30] Foreign Application Priority Data

Mar. 21, 1996 [DE] Germany ..... 196 11 095

[51] Int. Cl.[7] ..... F01P 3/22; F01P 7/14

[52] U.S. Cl. ..... 123/41.54; 123/41.02; 123/41.08; 123/41.15; 123/41.51; 165/104.32

[58] Field of Search ..... 123/41.02, 41.03, 123/41.08, 41.15, 41.51, 41.54, 41.27; 165/104.27, 104.32

[56] References Cited

U.S. PATENT DOCUMENTS

| | | | |
|---|---|---|---|
| 3,208,438 | 9/1965 | White . | |
| 3,238,932 | 3/1966 | Simpson . | |
| 4,052,965 | 10/1977 | Morris | 123/41.05 |
| 4,167,159 | 9/1979 | Warman | 123/41.08 |
| 4,478,178 | 10/1984 | Pernet | 123/41.01 |
| 4,510,893 | 4/1985 | Schweiger et al. . | |
| 4,640,235 | 2/1987 | Martin . | |
| 4,776,390 | 10/1988 | Crofts | 165/104.32 |
| 4,913,107 | 4/1990 | Schweiger | 123/41.54 |
| 5,163,506 | 11/1992 | Attinger et al. | 165/104.32 |
| 5,357,909 | 10/1994 | Attinger et al. | 123/41.54 |
| 5,522,456 | 6/1996 | Valk | 165/104.32 |

FOREIGN PATENT DOCUMENTS

| | | |
|---|---|---|
| 0295445 | 12/1988 | European Pat. Off. . |
| 136280 | 6/1979 | Germany . |
| 3143749 | 5/1983 | Germany . |
| 4233038 | 11/1993 | Germany . |
| 4428208 | 2/1996 | Germany . |

*Primary Examiner*—Tony M. Argenbright
*Assistant Examiner*—Brian J. Hairston
*Attorney, Agent, or Firm*—Evenson, McKeown, Edwards & Lenahan, P.L.L.C.

[57] ABSTRACT

For a cooling system of a liquid-cooled internal-combustion engine, a charging, venting and pressure control arrangement is suggested. In this case, a compressive stress mechanically generated in the coolant is combined with a forward-flow system control, in which case the gradual shutting-off or reduction of pressure is achieved into a pressureless coolant reserve acted upon by atmosphere. During cold charging, the arrangement provides a rapid filling of the cooling system with the coolant. Checking of the filling level in the reserve chamber in the case of operationally warm coolant without a loss of pressure and the risk of a coolant ejection is also permitted.

21 Claims, 5 Drawing Sheets

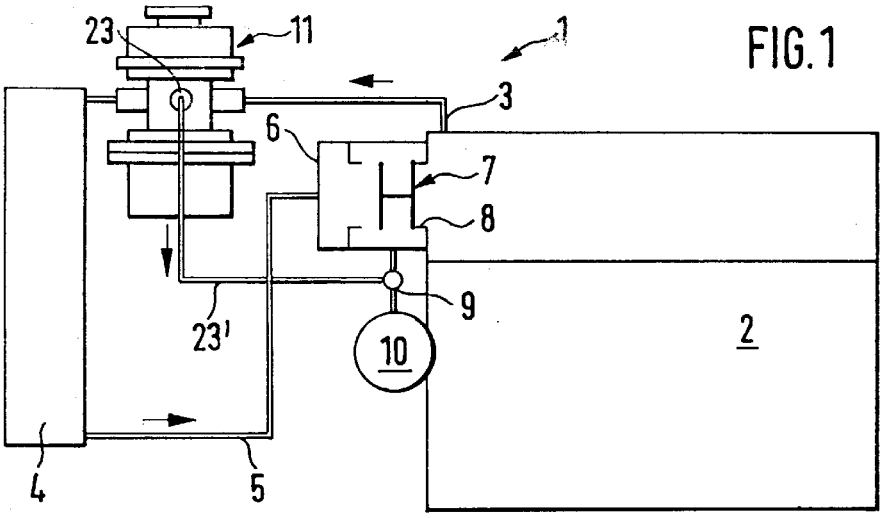
FIG. 1
FIG. 2
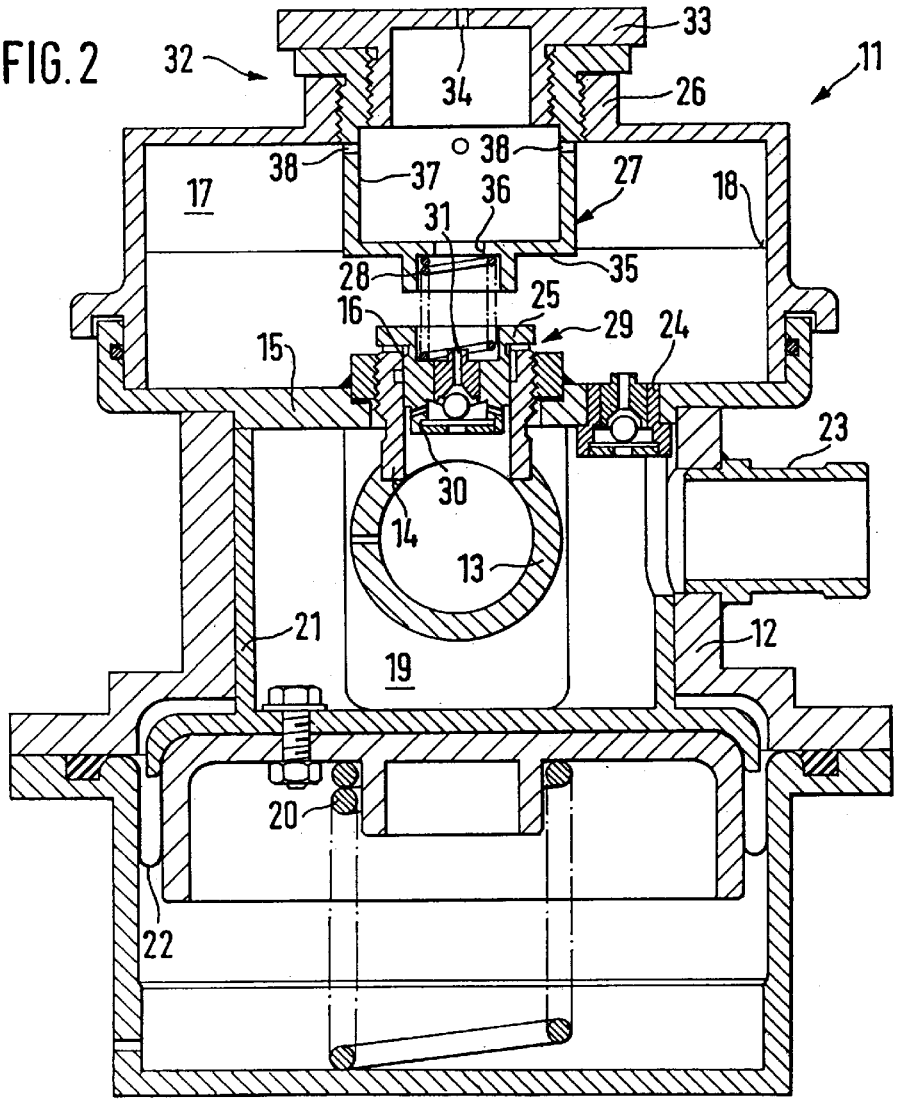

COOLING SYSTEM FOR A LIQUID-COOLED INTERNAL COMBUSTION ENGINE

This application is a 371 of PCT/EP97/01318 filed Mar. 15, 1997. The present invention is related to the subject matter of European Patent Document EP-A-0295445.

BACKGROUND AND SUMMARY OF THE INVENTION

In this known cooling system, a tank penetrated by a forward flow pipe is used for separating the air and fuel gas from the coolant. By means of a relief valve in a valve unit, which is arranged in an elastically supported manner against a closure of a filler neck of the tank, the separated gasses are fed to a compensation, storage and air blocking tank which is acted upon atmospherically. In addition to a coolant reserve, this compensation tank contains an expansion volume which consists of a gas cushion under a defined excess pressure.

With respect to compensation tanks which are formed essentially of rigid walls, for compensation of thermally caused coolant volume changes, elastic connection hoses between the internal-combustion engine and the radiator can be used as additional compensating devices. This is known per se, for example, from U.S. Pat. No. 3,208,438.

Compensation tanks with devices which are elastically flexible at least in certain areas are known from U.S. Pat. No. 3,238,932 and German Patent Document DD-PS 136280.

In each of the systems described in these documents, the necessary pressure buildup in a respective cooling system takes place by compressing a buffer air/gas volume, preferably in the compensation tank. A disadvantage, in this case, is that a relatively large expansion volume is needed in order to be able to absorb the volume increase of the coolant under extreme temperature conditions, such as, for example, reheating of a hot-parked internal-combustion engine, in order to prevent a possible coolant ejection or loss. Further, since the pressure buildup is significantly determined by the volume distribution between the coolant reserve and the buffer gas/air volume in the compensation tank, and when taking into account leakage and evaporation losses, a minimum charging level in the compensation tank is required. The requirement for a large buffer air/gas volume and a sufficient minimum reserve of coolant results in a relatively large compensation tank which, because of its space requirement, is difficult to place in the engine compartment and may cause unfavorable pipe arrangements.

One object of the present invention is to improve a cooling system of the above-mentioned type such that the pressure required in the cooling system for avoiding both premature boiling and pump cavitation is achieved without a prestressed buffer air/gas volume.

This object is achieved by the present invention, which provides the advantage of a combination of compressive stress mechanically generated in the coolant with a forward flow system pressure control. In this case, the gradual shutting-off or release of pressure is achieved into a "pressureless" coolant reserve acted upon by atmosphere. This results in an advantageously small charging, venting and pressure control arrangement which is preferably arranged in the coolant system forward flow from the internal-combustion engine to the radiator.

Advantageous further features of the invention are also described. The detachable arrangement of the valve unit is formed by the relief and vent and return flow valve. Forming the detachable arrangement in the valve connection piece of the forward flow pipe permits a rapid cold charging of the whole cooling system with rapid and reliable venting. The arrangement of the valve unit in the valve connection piece by means of an elastic support against an insert detachably arranged in the filler neck, in conjunction with the pressureless coolant reserve in an operationally warm cooling system, makes opening of the reserve chamber possible without a loss of pressure in the cooling system. Checking of the cooling reserve and optionally of the warm charging is permitted without any risk for the checking person as a result of coolant ejection.

A vent and return flow valve, which connects the compensation chamber with the reserve chamber, and a vent and return flow valve, which connects the forward flow pipe of the cooling system with the reserve chamber, are designed as thermostatic valves. Starting from a defined operating temperature, these thermostatic valves prevent a gas and coolant exchange and thus advantageously contribute to safe opening of the coolant reserve chamber.

The insert described above is detachably arranged in the filler neck and as an abutment for a spring which holds the valve unit in a closed position with respect to the relief valve. The insert is preferably constructed in a pot-shape with a control opening arranged in the bottom for checking the warm charge level. Finally, the displaceable boundary of the compensation chamber is a displacement piston which is arranged by way of roller bellows in a coolant-tight manner and is acted upon by a prestressed pressure spring. The prestressing of the pressure spring may be selected such that, until a predetermined level for reaching the pressure generated by the thermally caused volume change of the coolant in the coolant system is reached, a correspondingly slight displacement of the displacement piston will take place.

BRIEF DESCRIPTION OF THE DRAWINGS

An embodiment of the present invention illustrated in the drawings will now be described.

FIG. 1 is a view of a cooling system for a liquid-cooled internal-combustion engine;

FIG. 2 is a view of a charging, venting and pressure control arrangement;

DESCRIPTION OF THE PREFERRED EMBODIMENTS

Figure 3:
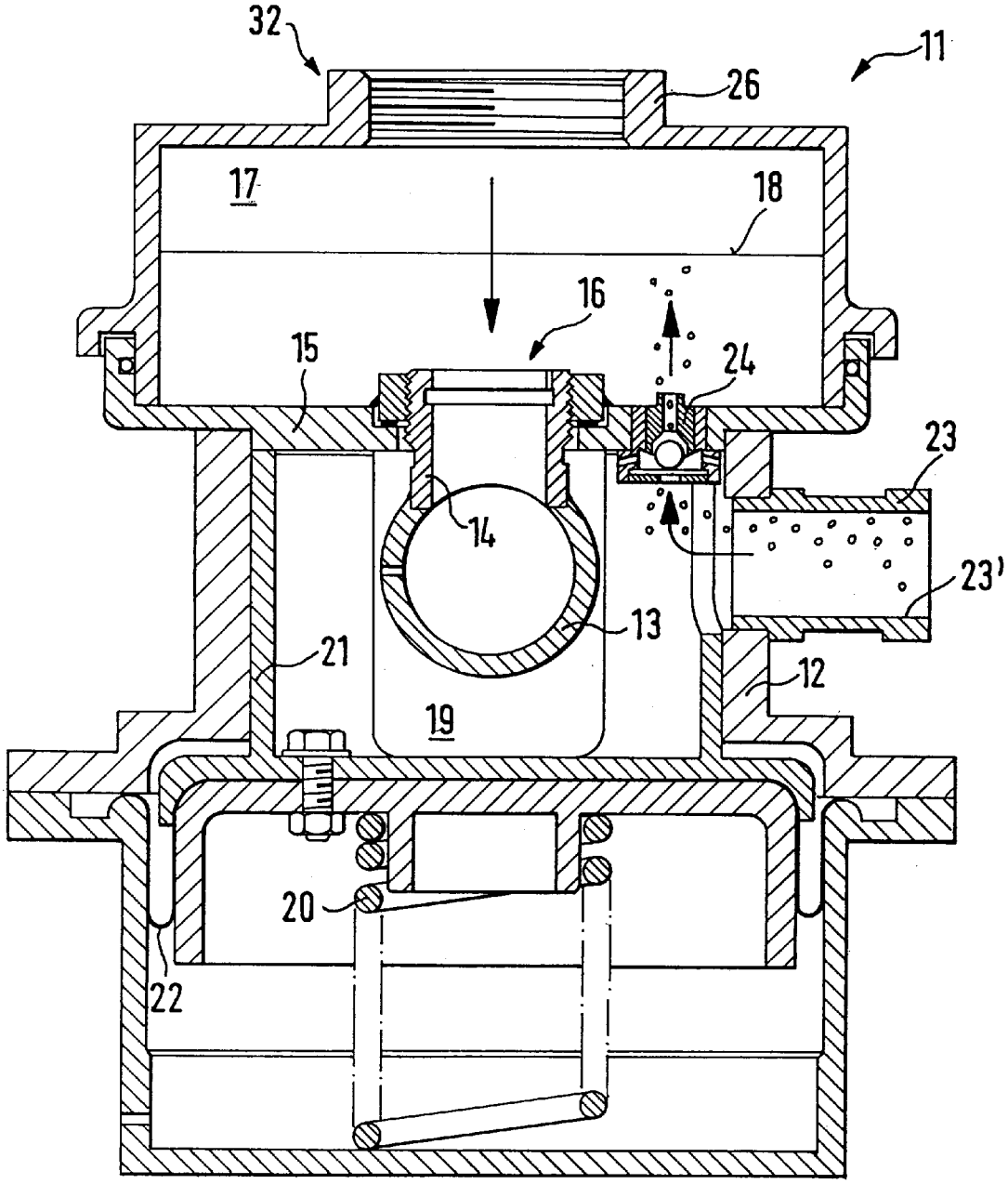
FIG. 3 is a view of the arrangement according to FIG. 2 prepared for cold charging.

A cooling system 1 for a liquid-cooled internal-combustion engine 2 comprises a forward flow 3 to a radiator 4 and, from this radiator 4 back to the internal-combustion engine 2, a return flow 5 which is connected to a housing 6 of a thermostat 7. From the housing 6 with the thermostat 7, which, as the result of the operation, closes the short circuit 6, the coolant flows by way of a suction pipe 9 to a pump 10 which conveys the coolant into the internal-combustion engine 2.

A charging, venting and pressure control arrangement 11 according to the invention is arranged in the forward flow 3 between the internal-combustion engine 2 and the radiator 4.

Figure 6:
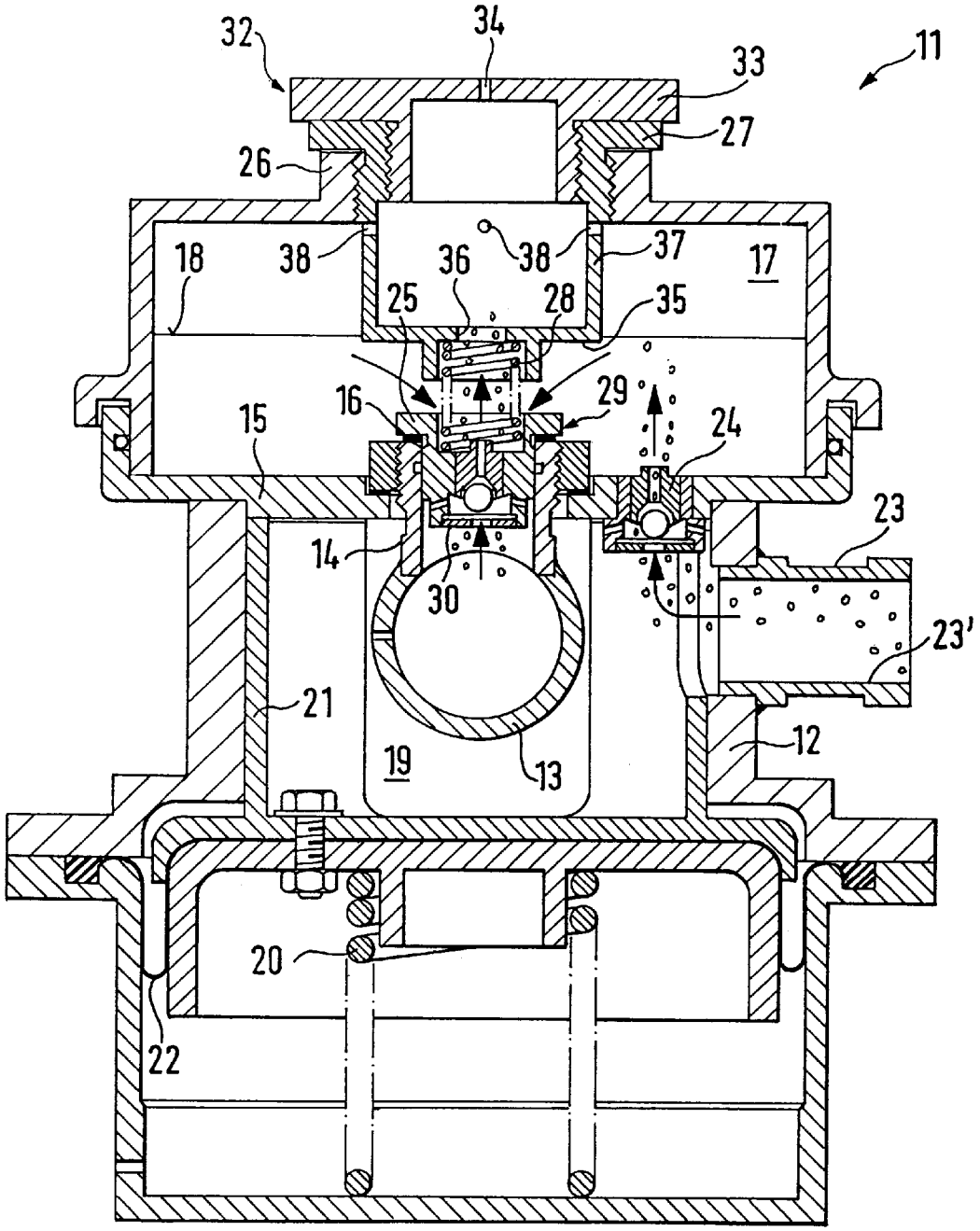
FIG. 6 is a view of the arrangement according to FIG. 2 during a cooling operation of a parked internal-combustion engine.

According to FIGS. 2 and 6, the arrangement 11 comprises a tank 12 which is penetrated by a forward-flow pipe 13 connected with the forward flow 3. The forward flow pipe 13 has a fixedly arranged valve connection piece 14 which is arranged to sealingly penetrate a partition 15 of the tank 12 and by means of its valve opening 16 leads into a chamber 17 for a coolant reserve 18 which is acted upon by atmosphere.

Below the partition 15, the tank 12 has another geodetically deeper chamber 19 which, by means of a displacement piston 21, which can be displaced against the elastic resistance of a pressure spring 20, is used for coolant volume compensation. The displacement piston is assigned in a coolant-tight manner to the compensation chamber 19 by the roller bellows 22.

By way of a connection piece 23 and a pipe 23', this compensation chamber 19 is in a coolant-carrying connection with the pump suction pipe 9 illustrated in FIG. 1. The compensation chamber 19 is connected with the coolant-reserve chamber 17 by way of a temperature-controlled venting and return flow valve 24. It is known that thermostats of this type are equipped, for example,. with a bimetallic element which, after a defined temperature is exceeded, brings a ball valve into the closing position and holds it there.

In the valve connection piece 14 of the forward flow pipe 13, a valve unit 25 for controlling the valve opening 16 is arranged so that it can be displaced against the resistance of a spring 28 supported against an insert 27 arranged in a screwed-in manner in a filler neck 26 of the reserve chamber 17. The valve unit 25 itself is used for the system pressure control of the cooling system 1 as a relief valve 29 opening into the atmospherically vented coolant reserve chamber 17.

The valve unit 25 also comprises a venting and return flow valve 30 which, as a thermostatic valve of the above-described design, controls, as a function of the temperature, a venting and return flow bore 31, which acts between the reserve chamber 17 and the forward flow pipe 13, in the relief valve 29 constructed as a seat valve.

A closing device 32 of the filler neck 26 of the reserve chamber 17 comprises, in addition to the pot-shaped insert 27 which can be screwed in, a closing lid 33, which can be screwed to this insert 27 and has a venting bore 34. In addition, in the bottom 35, which serves as a stop of the spring 28 of the valve unit 25, of a control opening 36 used for checking the warm charge level in the reserve chamber 17 as well as in the circumferential part 37, the pot-shaped insert 27 also has venting ducts 38 arranged close to the closing lid.

By means of the above-described arrangement according to the invention, when the closing lid 33, the insert 27 and the valve unit 25 are moved away from the valve connection piece 14, by way of this valve connection piece, cold charging of the cooling system 1 of the internal-combustion engine 2 can take place in rapid sequence. When cold charging as illustrated in FIG. 3 occurs, in comparison to conventional systems, an improvement of functions takes place. Such an improvement occurs because the coolant simultaneously reaches the internal-combustion engine 2 and the radiator 4, and the air situated in the internal-combustion engine cooling jacket can escape during the charging operation by way of the open reserve chamber 17, on the one hand, and through the opened valve 24, on the other hand. Rapid and complete charging which, as is known, can be achieved only by a vacuum, is possible by the illustrated system without additional expenditures.

Figure 4:
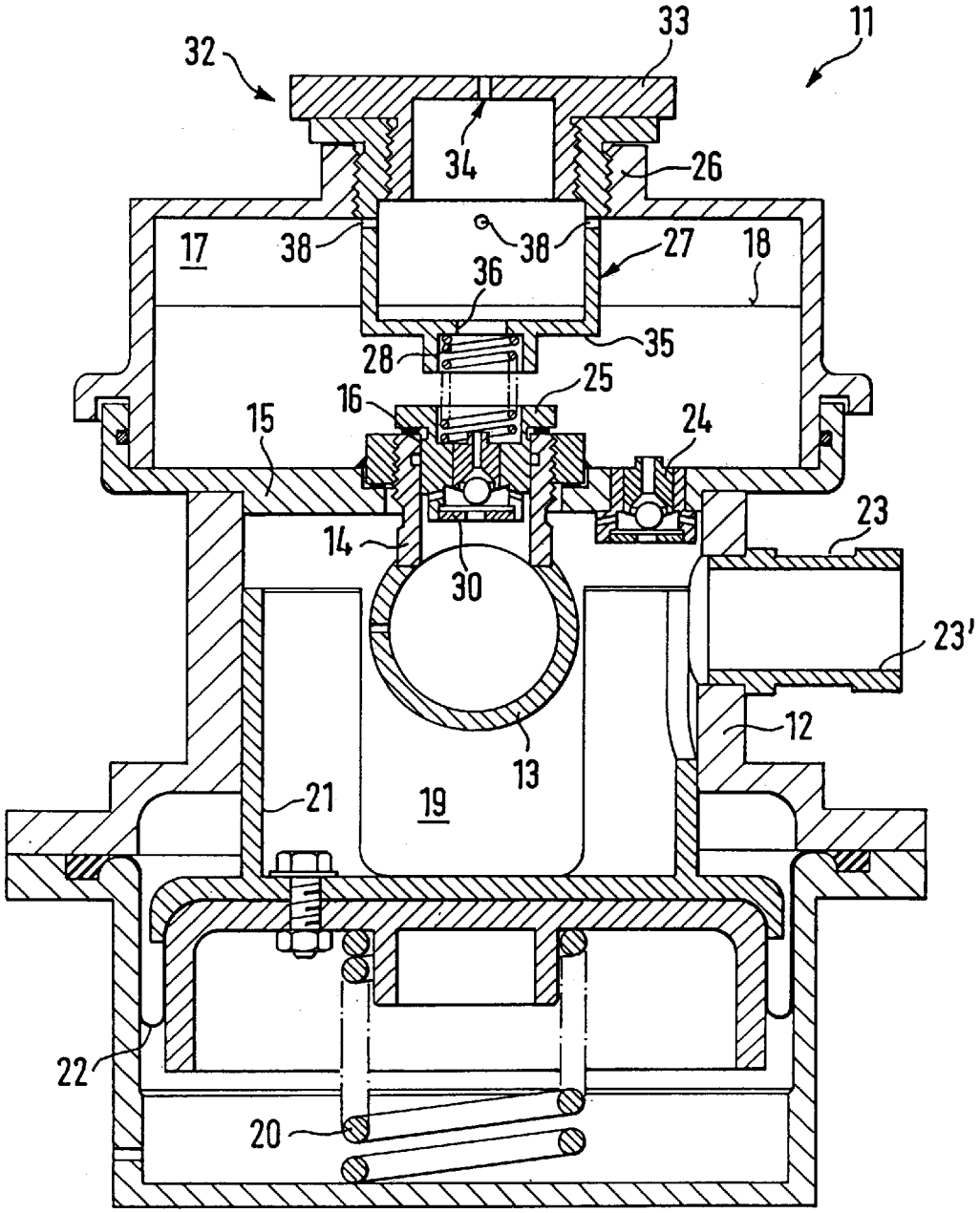
FIG. 4 is a view of the arrangement according to FIG. 2 during engine operation.

FIG. 4 illustrates the arrangement 11 in the operation of the internal-combustion engine 2, in which case the valves 24 and 30 should be closed. Corresponding to the temperature-caused coolant volume increase, a clear hysteresis-free connection exists here between the coolant temperature and the spring force of the pressure spring 20 or the pressure in the compensation chamber 19.

Figure 5:
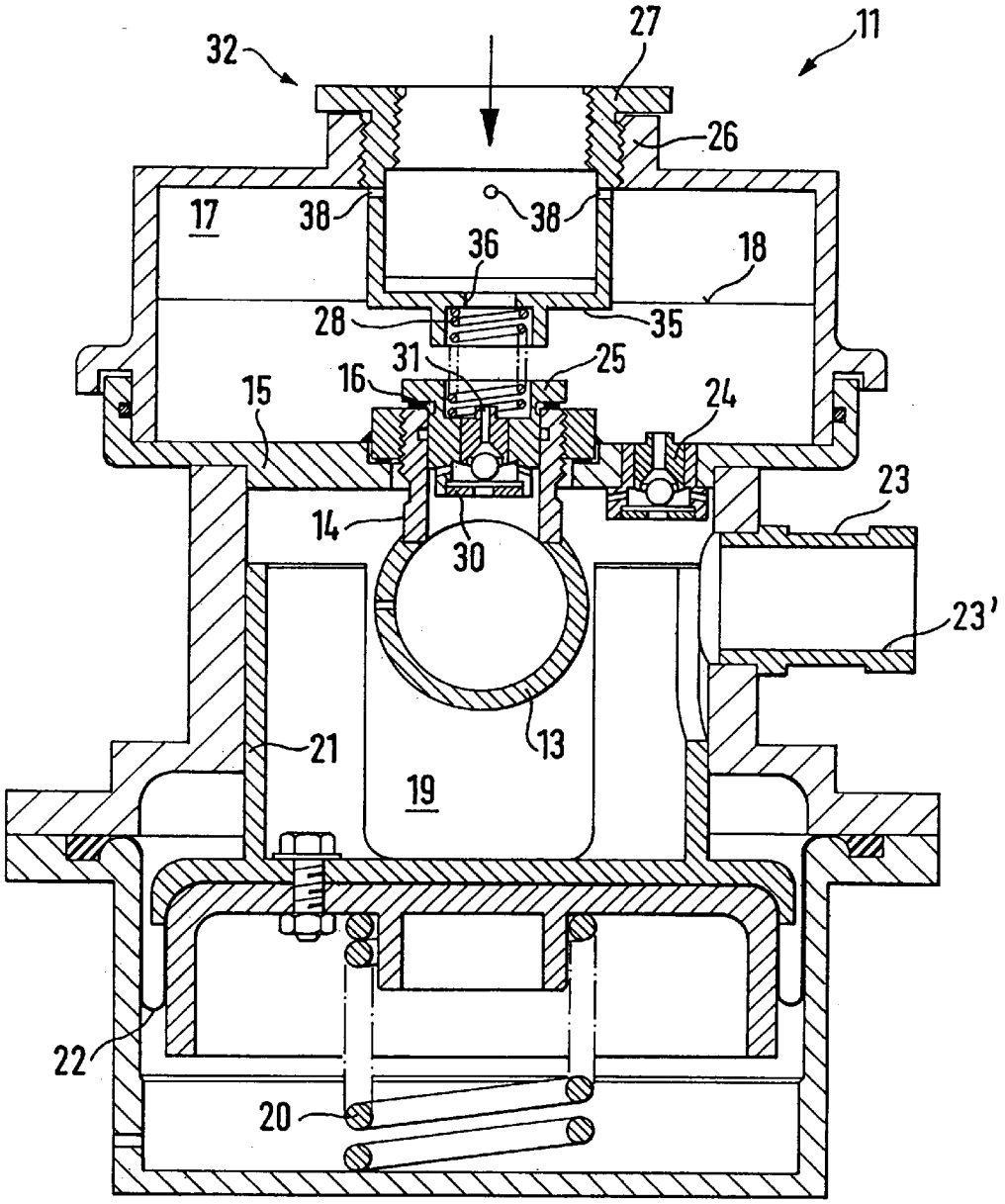
FIG. 5 is a view of the arrangement according to FIG. 2 in the case of warm charging occurring, for example, while the engine is running.

In addition, the arrangement in the device 11 advantageously provides warm charging of the cooling system 1 according to FIG. 5 without any losses of the system pressure and without the risk of a coolant ejection. When the valve unit 25 with the effectively closed thermostatic valve 30 is inserted and elastically supported against the screwed-in insert 27, only the closing lid 33 to the atmospherically acted-upon reserve chamber 17 must be removed for a possible recharging of coolant by way of the control opening 36 in the bottom 35 of the insert 27. In this case, the system pressure is maintained, in which case the absent coolant can be recharged. After the opening of the two venting and return flow valves 24 and 30 in the course of the next cooling operation in the internal-combustion engine 2 and the radiator 4, trapped air can escape, as illustrated in FIG. 6.

Finally, FIG. 6 shows a special gas removal operation during a cooling operation of the cooling system 1 after the internal-combustion engine 2 is switched off. In this case, air and fuel gas, by way of the opened valves 24 and 30 and by way of the pressureless reserve chamber 17, escape through the venting ducts 38 and the venting bore 34 in the closing lid 33 into the atmosphere. Subsequently, coolant advances from the reserve chamber 17 into the cooling system 1.

In summary, the charging, venting and pressure control arrangement 11 according to the invention has the following advantages.

Pressure in the area of the inlet of the forward flow device 3 into the radiator 4 is limited, in which case emerging coolant is not lost but is stored in the reserve chamber 17 and is supplied to the cooling system 1 again during the next cooling operation.

Air/gas and coolant are separated during the pressure buildup phase while warming-up.

System venting is performed after each cooling operation; this suppresses the pump-up tendency of the cooling system 1 caused, particularly in the case of diesel engines, by the fuel gas transfer into the coolant.

The pressure buildup - apart from system-caused quantities, such as the overall coolant content, the water/glycol mixing ratio and hose elasticity—depends on and is influenced by one quantity exclusively, specifically, the stiffness of the pressure spring 20.

I claim:

1. Cooling system for a liquid-cooled internal-combustion engine, comprising:

a pump which circulates a coolant, and a charging, venting and pressure control arrangement for controlling system pressure in a forward flow pipe, said arrangement including:

a tank in which the forward flow pipe is arranged in a penetrating manner and having a valve connection piece on said forward flow pipe substantially aligned with a filler neck, a valve unit controlling opposite flow directions received in said valve connection piece, a closing device of the filler neck against which the valve unit is elastically supported displaceably in the valve connection piece, the valve connection piece being arranged to penetrate a partition of the tank with a valve opening which opens into a coolant reserve chamber for a coolant reserve which is acted upon by atmosphere, an elastically flexible device which compensates thermally caused volume changes to the coolant circulated by said pump, said elastically flexible device including an additional, geodetically deeper compensation chamber of the tank, having a boundary which can be displaced against an elastic resistance, used for coolant volume compensation, a connection piece connecting the compensation chamber with a pump suction pipe of the cooling system, and a temperature-controlled venting and return flow valve by which the compensation chamber is connected with said coolant reserve chamber.

2. Cooling system according to claim 1, wherein the valve connection piece on the forward flow pipe is constructed so that said valve unit is removable for cold charging of the cooling system, and wherein, during warm charging of the cooling system, said valve unit is inserted and elastically supported in the valve connection piece against a bottom of an insert detachably arranged in the filler neck, said bottom being provided at a warm charging level in the coolant reserve chamber.

3. Cooling system according to claim 2, wherein the closing device of the filler neck comprises a pot-shaped insert which can be screwed to the filler neck, and a closing lid which interacts with the pot-shaped insert and has a venting bore, and wherein the bottom is used as the stop of a spring of the valve unit and the insert has a control opening used for checking a warm charging level as well as venting ducts arranged in a circumferential part close to the closing lid.

4. Cooling system according to claim 3, wherein said boundary of the compensation chamber comprises a displacement piston which is arranged in a coolant-tight manner by roller bellows, and wherein said displacement piston is acted upon by a pressure spring which is arranged in a prestressed manner supported against the tank.

5. Cooling system according to claim 3, wherein the charging, venting and pressure control arrangement with the coolant reserve which is acted upon by atmosphere in said coolant reserve chamber is arranged directly in a forward flow from the internal-combustion engine to a radiator.

6. Cooling system according to claim 2, wherein the valve unit comprises a venting and return flow valve which is constructionally combined with a relief valve, and wherein the venting and return flow valve is designed as a thermostatic valve controlling, as a function of the temperature, a venting and return flow bore effective between the coolant reserve chamber and the forward flow pipe, in the relief valve designed as a seat valve.

7. Cooling system according to claim 2, wherein said boundary of the compensation chamber comprises a displacement piston which is arranged in a coolant-tight manner by roller bellows, and wherein said displacement piston is acted upon by a pressure spring which is arranged in a prestressed manner supported against the tank.

8. Cooling system according to claim 2, wherein the charging, venting and pressure control arrangement with the coolant reserve which is acted upon by atmosphere in said coolant reserve chamber is arranged directly in a forward flow from the internal-combustion engine to a radiator.

9. Cooling system according to claim 1, wherein the valve unit comprises a venting and return flow valve which is constructionally combined with a relief valve, and wherein the venting and return flow valve is designed as a thermostatic valve controlling, as a function of the temperature, a venting and return flow bore effective between the coolant reserve chamber and the forward flow pipe, in the relief valve designed as a seat valve.

10. Cooling system according to claim 9, wherein the closing device of the filler neck comprises a pot-shaped insert which can be screwed to the filler neck, and a closing lid which interacts with the pot-shaped insert and has a venting bore, and wherein the bottom is used as the stop of a spring of the valve unit and the insert has a control opening used for checking a warm charging level as well as venting ducts arranged in a circumferential part close to the closing lid.

11. Cooling system according to claim 9, wherein said boundary of the compensation chamber comprises a displacement piston which is arranged in a coolant-tight manner by roller bellows, and wherein said displacement piston is acted upon by a pressure spring which is arranged in a prestressed manner supported against the tank.

12. Cooling system according to claim 9, wherein the charging, venting and pressure control arrangement with the coolant reserve which is acted upon by atmosphere in said coolant reserve chamber is arranged directly in a forward flow from the internal-combustion engine to a radiator.

13. Cooling system according to claim 1, wherein said boundary of the compensation chamber comprises a displacement piston which is arranged in a coolant-tight manner by roller bellows, and wherein said displacement piston is acted upon by a pressure spring which is arranged in a prestressed manner supported against the tank.

14. Cooling system according to claim 13, wherein the charging, venting and pressure control arrangement with the coolant reserve which is acted upon by atmosphere in said coolant reserve chamber is arranged directly in a forward flow from the internal-combustion engine to a radiator.

15. Cooling system according to claim 1, wherein the charging, venting and pressure control arrangement with the coolant reserve which is acted upon by atmosphere in said coolant reserve chamber is arranged directly in a forward flow from the internal-combustion engine to a radiator.

16. Cooling system for a liquid-cooled internal-combustion engine, comprising:

a pump which circulates a coolant, a tank into which a forward flow pipe opens and having a valve connection piece on said forward flow pipe substantially aligned with a filler neck, a valve unit controlling opposite flow directions in the tank between a coolant reserve chamber for a coolant reserve which is acted upon by atmosphere and a compensation chamber, a closing device of the filler neck against which the valve unit is elastically and displaceably supported in the valve connection piece, an elastically flexible device which compensates for thermally caused volume changes to the coolant and including a displaceable boundary defining said compensation chamber and which can be displaced against an elastic resistance to compensate for said volume changes, a connection piece connecting the compensation chamber with a pump suction pipe of the cooling system, and a temperature-controlled venting and return flow valve by which the compensation chamber is connected with said coolant reserve chamber.

17. Cooling system according to claim 16, wherein the valve unit is removable for cold charging of the cooling system.

18. Cooling system according to claim 17, wherein the valve unit comprises a venting and return flow valve which is constructionally combined with a relief valve.

19. Cooling system according to claim 18, wherein the venting and return flow valve is designed as a thermostatic valve controlling, as a function of the temperature, communication between the coolant reserve chamber and the forward flow pipe.

20. Cooling system according to claim 16, wherein said displaceable boundary comprises a displacement piston which is arranged in a coolant-tight manner by roller bellows.

21. Cooling system according to claim 20, wherein said displacement piston is acted upon by a pressure spring which is arranged in a prestressed manner supported against the tank.

* * * * *